US006539859B2

(12) United States Patent
Williams

(10) Patent No.: US 6,539,859 B2
(45) Date of Patent: Apr. 1, 2003

(54) MULTICOLOR PRINTING PRESS

(75) Inventor: Richard A. Williams, Hampstead, NH (US)

(73) Assignee: Presstek, Inc., Hudson, NH (US)

( * ) Notice: Subject to any disclaimer, the term of this patent is extended or adjusted under 35 U.S.C. 154(b) by 0 days.

(21) Appl. No.: 09/977,743

(22) Filed: Oct. 15, 2001

(65) Prior Publication Data

US 2002/0043165 A1 Apr. 18, 2002

Related U.S. Application Data

(60) Provisional application No. 60/241,056, filed on Oct. 17, 2000.

(51) Int. Cl.[7] ..... B41M 1/14

(52) U.S. Cl. ..... 101/175; 101/135; 101/177; 101/211; 101/382.1; 101/415.1

(58) Field of Search ..... 101/171, 175, 101/211, 177, 415.1, 382.1, 378, 135

(56) References Cited

U.S. PATENT DOCUMENTS

| | | | | | |
|---|---|---|---|---|---|
| 15,286 | A | * | 7/1856 | Schultz | 164/77 |
| 33,897 | A | | 12/1861 | Montague | |
| 302,244 | A | | 7/1884 | Forbes | |
| 517,908 | A | | 4/1894 | Wendte | |
| 519,461 | A | | 5/1894 | Wendte | |
| 519,462 | A | | 5/1894 | Wendte | |
| 724,997 | A | | 4/1903 | Flora | |
| 787,209 | A | | 4/1905 | McKee | |
| 1,085,224 | A | * | 1/1914 | Roesen | 101/137 |
| 1,724,644 | A | | 8/1929 | De Long | |
| 1,919,462 | A | | 7/1933 | Claybourn | |
| 1,941,241 | A | | 12/1933 | Barber | |
| 1,944,703 | A | | 1/1934 | Barber | |
| 1,986,385 | A | | 1/1935 | Barber | |
| 2,117,546 | A | | 5/1938 | Dobroth, Jr. | 101/174 |
| 2,397,053 | A | | 3/1946 | Schneider | 101/137 |
| 4,011,812 | A | | 3/1977 | Julian Lecha | 101/176 |
| 4,241,657 | A | | 12/1980 | Fujimori | 101/211 |
| 4,388,628 | A | | 6/1983 | Moriguchi et al. | 346/76 |
| 4,395,946 | A | | 8/1983 | Price | 101/152 |
| 4,509,424 | A | | 4/1985 | Germann | 101/177 |
| 4,854,232 | A | | 8/1989 | Oda | 101/211 |
| 4,905,595 | A | | 3/1990 | Jeschke | 101/174 |
| 4,911,075 | A | | 3/1990 | Lewis et al. | 101/453 |
| 4,936,211 | A | | 6/1990 | Pensavecchia et al. | 101/136 |
| 5,009,160 | A | | 4/1991 | Duarte | 101/422 |
| 5,174,205 | A | | 12/1992 | Kline et al. | 101/136 |
| 5,339,737 | A | | 8/1994 | Lewis et al. | 101/454 |
| 5,353,703 | A | | 10/1994 | Rieker | 101/177 |
| 5,355,795 | A | | 10/1994 | Moss et al. | 101/141 |
| 5,469,787 | A | * | 11/1995 | Turner et al. | 101/211 |
| 5,660,108 | A | | 8/1997 | Pensavecchia | 101/137 |
| 5,727,749 | A | | 3/1998 | Pensavecchia et al. | 242/539.3 |
| 5,806,426 | A | | 9/1998 | Choulet | 101/211 |
| 5,813,345 | A | | 9/1998 | Fuller et al. | 101/463.1 |
| 5,823,109 | A | | 10/1998 | Hummel et al. | 101/350.4 |
| 6,026,747 | A | | 2/2000 | Carme et al. | 101/415.1 |
| 6,302,018 | B1 | * | 10/2001 | Aoyama et al. | 101/142 |

* cited by examiner

*Primary Examiner*—Andrew H. Hirshfeld
*Assistant Examiner*—Kevin D. Williams
(74) *Attorney, Agent, or Firm*—Testa, Hurwitz & Thibeault, LLP

(57) ABSTRACT

A multicolor lithographic printing press utilizes a blanket member having a release surface with a transfer rate approaching 100%. This facilitates a press design utilizing a single blanket member to transfer multiple colors of ink onto a recording medium.

12 Claims, 3 Drawing Sheets

MULTICOLOR PRINTING PRESS

RELATED APPLICATION

This application claims the benefits of U.S. Provisional Application No. 60/241,056, filed Oct. 17, 2000, the entire disclosure of which is hereby incorporated by reference.

BACKGROUND OF THE INVENTION

1. Field of the Invention

The present invention relates to digital printing apparatus and methods, and more particularly to a printing apparatus capable of multiple color applications in a single plate cylinder rotation.

2. Description of the Related Art

Traditional techniques of introducing a printed image onto a recording material include letterpress printing, gravure printing and offset lithography. All of these printing methods require a plate, usually loaded onto a plate cylinder of a rotary press for efficiency, to transfer ink in the pattern of the image. In letterpress printing, the image pattern is represented on the plate in the form of raised areas that accept ink and transfer it onto the recording medium by impression. Gravure printing plates, in contrast, contain series of wells or indentations that accept ink for deposit onto the recording medium; excess ink must be removed from the plate by a doctor blade or similar device prior to contact between the plate and the recording medium.

In the case of offset lithography, the image is present on a plate or mat as a pattern of ink-accepting (oleophilic) and ink-repellent (oleophobic) surface areas. In a dry printing system, the plate is simply inked and the image transferred onto a recording medium; the plate first makes contact with a compliant intermediate surface called a blanket member which, in turn, applies the image to the paper or other copying medium. In typical rotary press systems, the recording medium is attached to an impression cylinder, which brings it into contact with the blanket member.

In a wet lithographic system, the non-image areas are hydrophilic, and the necessary ink-repellency is provided by an initial application of a dampening (or "fountain") solution to the plate prior to inking. The fountain solution prevents ink from adhering to the nonimage areas, but does not affect the oleophilic character of the image areas.

The plates for an offset printing press are produced photographically or through digital imaging. Traditionally, plates have been affixed to the plate cylinders of the press by means of clamps and the like. More recent systems, however, eliminate the chore of removing and replacing spent plates by locating a continuous supply of imageable plate material within a cavity within the plate cylinder. Each time a printing job is completed, fresh plate material is advanced around the cylinder to replace the spent segment.

Photographic platemaking processes tend to be time-consuming and require facilities and equipment adequate to support the necessary chemistry. To circumvent these shortcomings, practitioners have developed a number of electronic alternatives to plate imaging, some of which can be utilized on-press. With these systems, digitally controlled devices alter the ink-receptivity of blank plates in a pattern representative of the image to be printed. Such imaging devices include sources of electromagnetic-radiation pulses, produced by one or more laser or non-laser sources, that create chemical changes on plate blanks (thereby eliminating the need for a photographic negative); ink-jet equipment that directly deposits ink-repellent or inkaccepting spots on plate blanks; and spark-discharge equipment, in which an electrode in contact with or spaced close to a plate blank produces electrical sparks to physically alter the topology of the plate blank, thereby producing "dots" which collectively form a desired image (see, e.g., U.S. Pat. No. 4,911,075, co-owned with the present application and hereby incorporated by reference). For example, the plate material may be imaged utilizing an imager comprising a laser device that either ablates one or more layers of plate material or physically transforms a surface layer. See, e.g., U.S. Pat. No. 5,339,737 co-owned with the present application and hereby incorporated by reference.

In most conventional presses, if a press is to print in more than one color, a separate printing member corresponding to each color is required. The original image is transformed into a series of imagewise patterns, or "separations," that each reflect the contribution of the corresponding printable color. The positions of the printing members are coordinated so that the color components printed by the different members will be in register on the printed copies. Each printing member ordinarily is mounted on (or integral with) a "plate" cylinder, and the set of cylinders associated with a particular color on a press is usually referred to as a printing station. Typically each such station typically includes an impression cylinder, a blanket member, a plate cylinder and the necessary ink (and, in wet systems, dampening) assemblies. The recording medium is transferred among the print stations sequentially, each station applying a different ink color to a material to produce a composite multicolor image.

Central impression designs reduce the number of press components and printing errors arising from paper handoff by minimizing the number of times a sheet is actually transferred. The sheet may, for example, be withdrawn from a bin and affixed to the central impression cylinder in a single operation, and stripped from the cylinder only after traversing all printing stations. In this way, misregistration errors are substantially reduced, since the opportunity for paper slippage between stations is removed. Furthermore, any errors resulting from initial paper handling are not amplified, since the orientation of the paper with respect to the printing stations remains essentially fixed.

Unfortunately, even with central impression designs, each color component requires a separate and unique printing station. Accordingly, the configuration of a conventional multicolor press is comparatively complex, expensive and large.

DESCRIPTION OF THE INVENTION

Brief Summary of the Invention

In accordance with the invention, use of a blanket member having a release surface with a transfer rate approaching 100% facilitates a press design utilizing a single blanket member to transfer multiple colors of ink onto a recording medium. As a result, a multicolor press may include a single, large plate cylinder having multiple image regions, a single blanket member and a single impression cylinder. This approach is substantially simpler than traditional designs, which, as noted above, contemplate a separate printing station (with its own plate cylinder, blanket member and impression cylinder) for each color and complex "handoff" mechanisms to transfer recording media sequentially among the printing stations.

Accordingly, in a first aspect, a press in accordance with the invention comprises a plate cylinder having a plurality of image regions, one or more imagers for placing a lithographic image on the plate material at each of the image regions, one or more inking mechanisms for transferring a different color of ink to each of the images, and a single blanket member in rolling contact with the plate cylinder for sequentially receiving the ink from each of the images as the plate cylinder rotates. The blanket member receives successive applications of ink and transfers these to a recording medium, which is typically pinned to an impression cylinder in rolling contact with the blanket member. Again, because of the high release efficiency of the blanket member, the same member is capable of receiving and transfering sequential applications of differently colored ink.

In general, if the plate cylinder has a diameter D and N image regions, the diameter of the blanket member and the impression cylinder will be D/N. It should be noted that this relationship does not require a cylindrical blanket member; for example, the blanket member may be in the form of a belt with an exterior length D/N. In one embodiment, the diameter of the plate cylinder is four times that of that of the blanket member and the press contains four image regions evenly distributed about the circumference of the plate cylinder.

In preferred embodiments, a multicolor press in accordance with the invention contains multiple winding mechanisms within the plate cylinder, which are selectively actuable so as to pay out material across the cylinder segments corresponding to the image regions. For example, the winding mechanisms may be differently geared to cylinder rotation, such that rotation of the cylinder in a first direction advances material from a first winding mechanism across a first circumferential portion of the cylinder to a second winding mechanism; while rotation of the cylinder in the opposite direction advances material from the second winding mechanism across a second circumferential portion of the cylinder (which may, for example, be diametrically opposed to the first cylinder portion) to the first winding mechanism. Alternatively, material advancement may be achieved by means of one or more dedicated motors rather than mechanical coupling to cylinder rotation.

In accordance with these embodiments, therefore, at least two winding mechanisms are desirably distributed around a cylinder. Each winding mechanism includes rotatable supply and take-up spools within the cylinder, and means for winding material onto the take-up spool. The supply spool of each winding mechanism is configured to dispense recording material over a travel path extending around the cylinder to the take-up spool of an adjacent winding mechanism. Accordingly, material may be advanced from a selected winding mechanism (with the remainder inactive).

In a second aspect, the invention comprises a printing method. A plate cylinder having a plurality of image regions is provided, and plate material is disposed on the plate cylinder. A lithographic image is applied to the plate material at each of the image regions. During printing, ink is transferred to each of the images, with each image receiving ink of a different color. A single blanket member in rolling contact with the plate cylinder sequentially receives the ink from each of the images as the plate cylinder rotates and transfers the ink to a recording medium.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
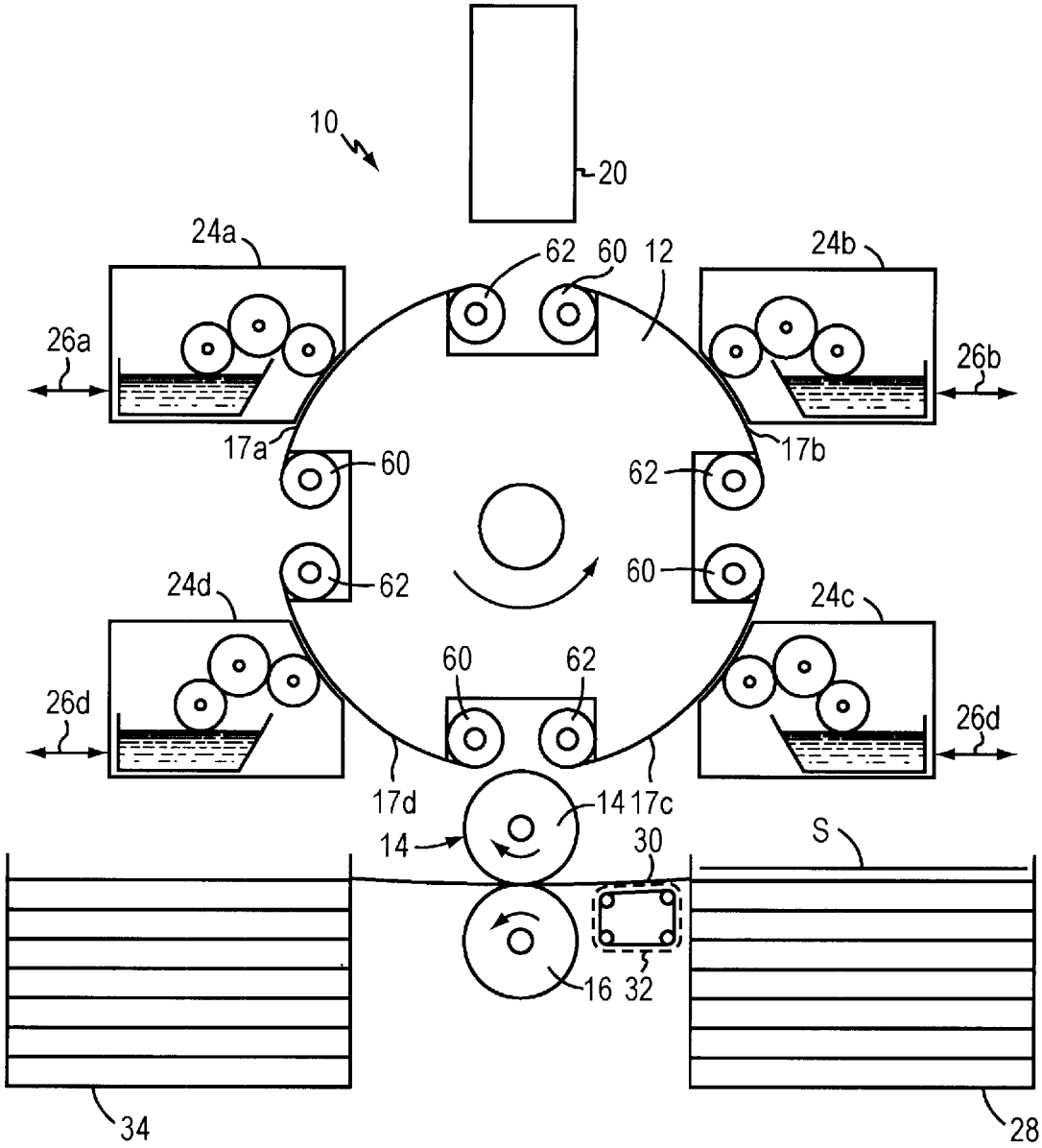
FIG. 1 is diagrammatic view of a system according to the invention configured for printing four colors.

With reference to FIG. 1, a representative press in accordance with the invention includes a plate cylinder 12, a blanket member 14, and an impression cylinder 16. Blanket member 14 is in rolling contact with both plate cylinder 12 and impression cylinder 16. Plate cylinder 12 comprises a plurality of image regions 17*a*–17*d* disposed about its circumference. In one embodiment, blanket member 14 is a cylinder as shown. In other embodiments blanket member 14 comprises a belt structure with an exterior length equivalent to the circumference of impression cylinder 16. In any case, blanket member 14 has a surface 14*s* exhibiting an inktransfer rate approaching 100%. As a result, substantially all the ink received by the blanket layer 14*s* from each image region 17*a*–17*d* is transferred to a recording medium pinned to impression cylinder 16, each such successive application generally involving ink of a different color. Each time blanket member 14 rotates, it transfers ink from one image region as it acquires ink from the next image region. Thus, for each full revolution of plate cylinder 12, blanket member 14 transfers ink from all of the image regions 17*a*–17*d* of plate cylinder 12 to a recording medium pinned to impression cylinder 16. Suitable clamps (not shown) for securing a recording medium to impression cylinder 16 are conventional and well-characterized in the art.

At least one imaging unit 20 is positioned adjacent to the plate cylinder 12 for placing lithographic images on the image regions 17*a*–17*d*. The nature of imager 20 is not critical to the invention, and depends on the nature of plate material 20. In a preferred embodiment, imager 20 comprises a series of lasers that ablate or physically transform plate material on the image regions. Imager 20 scans axially across plate cylinder 12 as the cylinder rotates, placing a circumferential line of image spots on each image region 17*a*–17*d* during each cylinder rotation. The imager receives data from two sources. The angular position of cylinder 12 with respect to imager 20 is constantly monitored by a detector, which provides signals indicative of that position to imager 20. In addition, an image data source (e.g., a computer) also provides data signals to imager 20. The image data define points on image regions 17*a*–17*d* where image spots are to be written. Imager 20 correlates the instantaneous relative positions of its constituent lasers and plate cylinder 12 (as reported by the detector) with the image data to actuate the appropriate laser drivers at the appropriate times during scan of cylinder 12. Suitable control circuitry to accomplish this is set forth, for example, in U.S. Pat. No. 5,174,205, coowned with the present application and hereby incorporated by reference.

Press 10 also includes a series of inking mechanisms 24*a*–24*d*, each of which applies ink to a corresponding one of the image regions 17*a*–17*d*. Because each inking mechanism is intended to contact only a single region of plate material surrounding cylinder 12, it is advanced to encounter its assigned region when adjacent thereto but kept retracted at all other times. This is accomplished using slidable mounts and reciprocation mechanisms indicated at 26*a*–26*d*, each associated with one of the inking mechanisms 24*a*–24*d*. For example, the reciprocation mechanism may be a cam and a cam follower arranged so that at least part of the inking mechanism moves toward and away from plate cylinder 12 during each rotation thereof. Alternatively, reciprocation mechanisms 26*a*–26*d* may utilize pneumatic or hydraulic cylinders (see, e.g., U.S. Pat. No. 5,813,345, co-owned with the present application and hereby incorporated by reference).

Individual paper sheets S are fed to the impression cylinder 16 from a feeder tray 28 at the right-hand side of the press 10 as viewed in FIG. 1. The impression cylinder 16 is provided with a circumferential array of paper clamping or gripping assemblies (see, e.g., U.S. Pat. No. 5,660,108, co-owned with the present application and hereby incorporated by reference). At appropriate points in the rotation of the plate cylinder 12, while the cylinder continues to rotate, the topmost paper sheet in feeder tray 28 is retrieved from the stack and carried along a guide 30 leading toward impression cylinder 16 by a conventional paper feeding mechanism shown generally at 32. Following multiple rotations of impression cylinder 16 that result in all images being applied in register to the sheet, it is released into a collection bin 34.

In general it is desirable to dispense plate material across each image region 17*a*–17*d* using separate winding mechanisms. In this way, reasonably large supplies of rolled plate material can be located within the interior of plate cylinder 12, and following each printing job, fresh plate material may be advanced independently across some or all of the image regions. This arrangement relieves the press operator of the need to physically mount new plate material to multiple cylinder regions.

Figure 2:
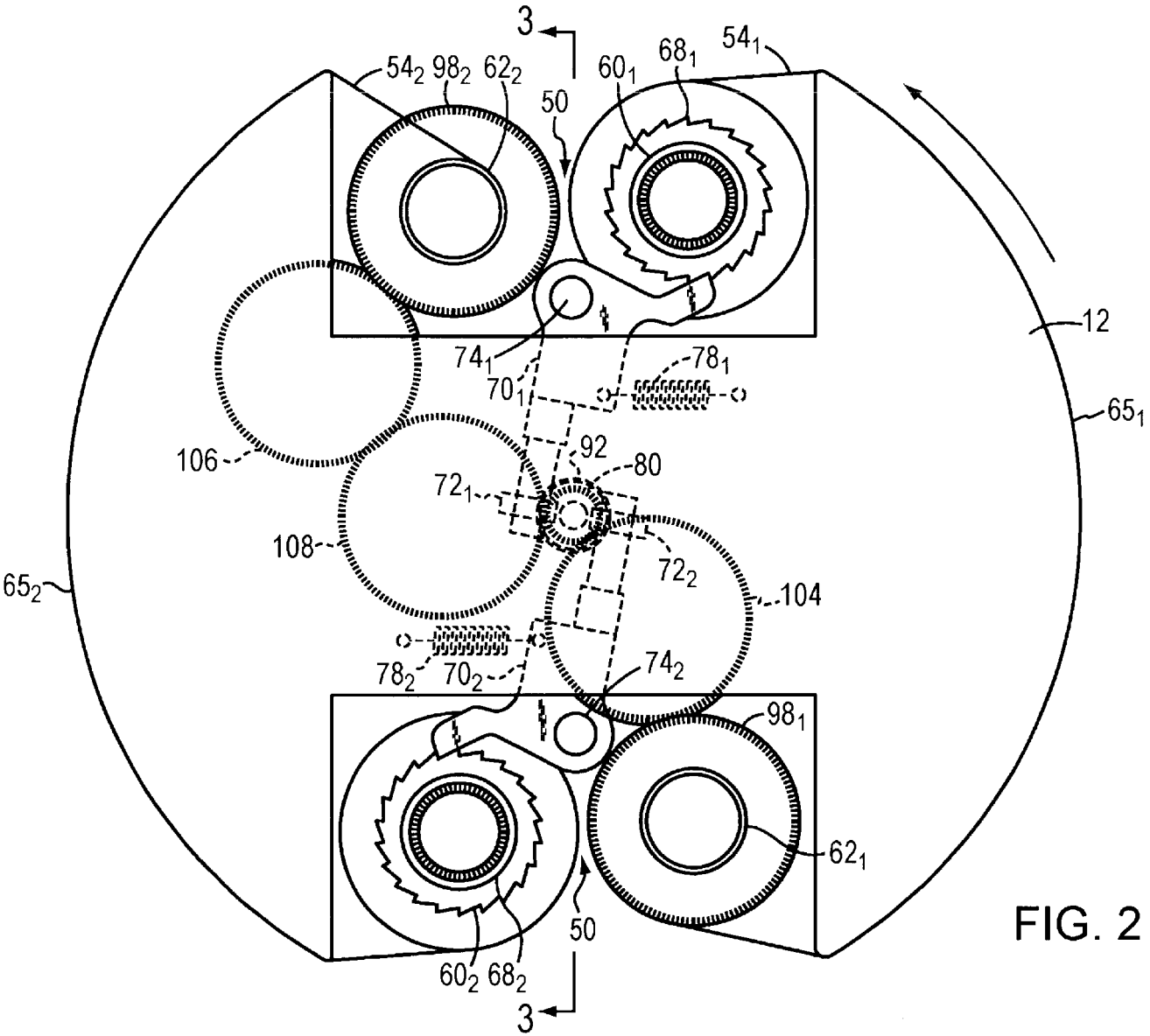
FIG. 2 is an end view of a plate cylinder useful in connection with the present invention, with the external drive components omitted for clarity.
Figure 3:
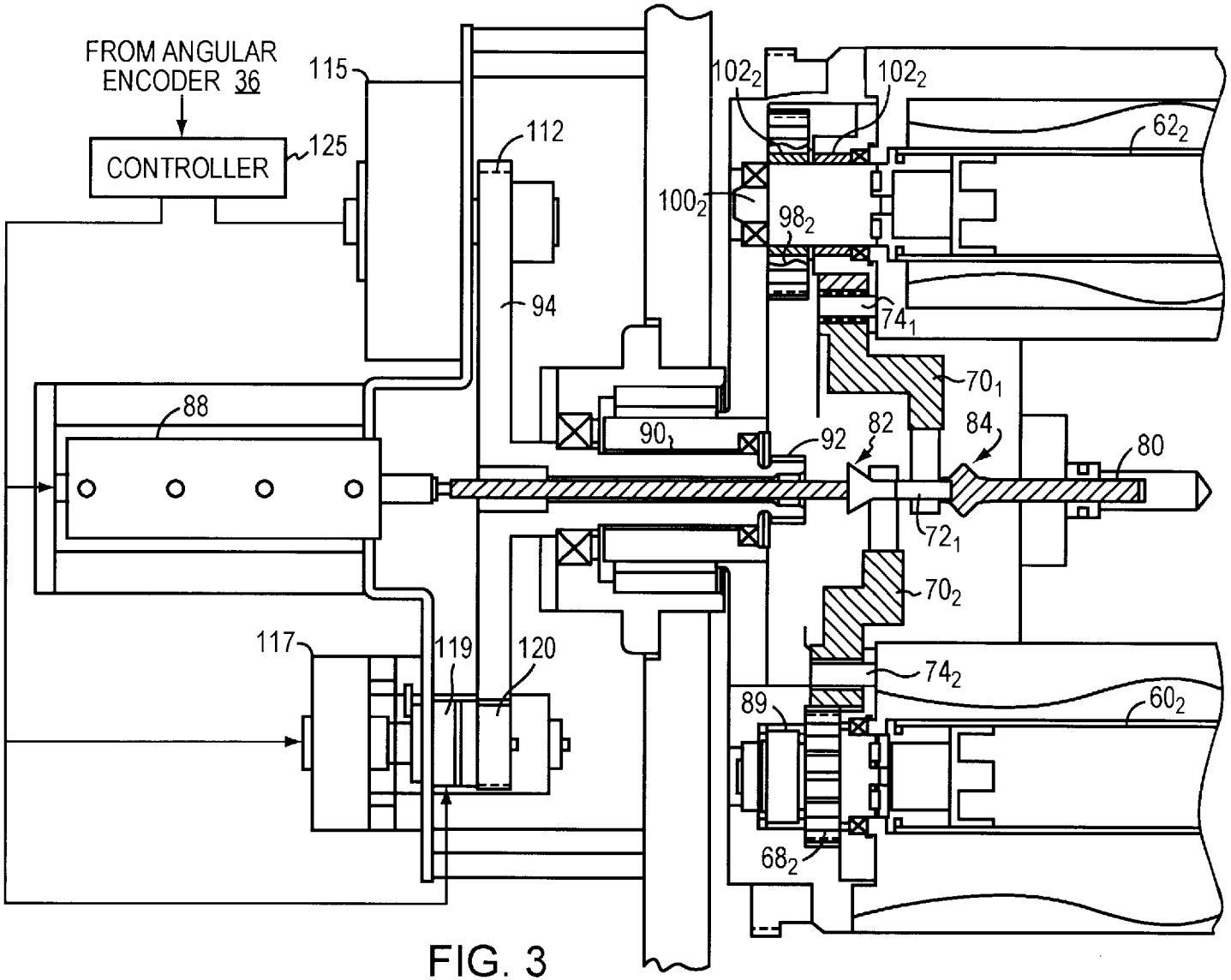
FIG. 3 is a sectional view of the plate cylinder shown in FIG. 2, taken along the line 3—3.

FIGS. 2 and 3 illustrate the components of a suitable plate-material supply and take-up apparatus. For ease of illustration and explanation, the depicted apparatus is adapted for two image regions with diametrically opposed printing segments, it being understood that more than two mechanisms may be distributed around the cylinder.

With reference to FIG. 2, the plate-material supply and take-up components are located in a pair of opposed cavities 50, 52 within cylinder 12. A first segment $\mathbf{54}_1$ of plate (or other recording) material wraps around a portion of the surface of cylinder 12, extending from a supply spool $\mathbf{60}_1$ rotatable within cavity 50 to a take-up spool $\mathbf{62}_1$ rotatable within cavity 52. Accordingly, rotation of take-up spool $\mathbf{62}_1$ causes supply spool $\mathbf{60}_1$ to dispense recording material over a travel path extending around a portion $\mathbf{65}_1$ of cylinder 12, from cavity 50 to cavity 52.

A second segment $\mathbf{54}_2$ of plate material wraps around an opposed portion of the surface of cylinder 12, extending from a supply spool $\mathbf{60}_2$ rotatable within cavity 52 to a take-up spool $\mathbf{62}_2$ rotatable within cavity 50. The travel path of segment $\mathbf{54}_2$ extends around a portion $\mathbf{65}_2$ of cylinder 12, from cavity 52 to cavity 50. The spools may be mounted within cylinder 12 in any number of suitable manners. These include placement within a frame or cassette, or installed and removed individually.

Furthermore, the surface of cylinder 12 may have a texture that allows plate material to pass easily thereover as it is advanced, but which also prevents slippage of the plate material when stationary. We have found that a tungsten carbide coating, applied by plasma spraying to a moderate degree of roughness, fulfills these criteria satisfactorily.

Each supply spool $\mathbf{60}_1$, $\mathbf{60}_2$ contains a respective ratchet $\mathbf{68}_1$, $\mathbf{68}_2$. A pair of pawls $\mathbf{70}_1$, $\mathbf{70}_2$, each having a respective cam follower $\mathbf{72}_1$, $\mathbf{72}_2$ extending therefrom, are rotatable about respective pivots $\mathbf{74}_1$, $\mathbf{74}_2$. The tooth of each pawl $\mathbf{70}_1$, $\mathbf{70}_2$ engages the corresponding ratchet $\mathbf{68}_1$, $\mathbf{68}_2$. A pawl spring $\mathbf{78}_1$, $\mathbf{78}_2$, extending between the arm of pawl $\mathbf{70}_1$, $\mathbf{70}_2$ and a point within plate cylinder 12 that remains stationary with respect to pawl $\mathbf{70}_1$, $\mathbf{70}_2$, urges the pawl against the corresponding ratchet $\mathbf{68}_1$, $\mathbf{68}_2$.

With reference to FIG. 3, the movement of pawls 70 is controlled by a linear cam shaft 80 having a pair of camming surfaces 82, 84. Cam shaft 80, in turn, is reciprocated by a three-position pneumatic cylinder 88. In the middle position, illustrated in the figure, neither cam follower 72 is displaced, so that both pawls 70 remain engaged to their respective ratchets 68. When shaft 80 is advanced by cylinder 88, cam surface 82 displaces cam follower $\mathbf{72}_2$ (see FIG. 2), releasing pawl 702 from engagement with ratchet $\mathbf{68}_2$; when shaft 80 is retracted, cam surface 84 displaces cam follower $\mathbf{72}_1$ in an analogous fashion (best shown in FIG. 3). When either pawl 70 disengages its corresponding ratchet 68, the associated supply spool 62 is free to rotate and dispense fresh plate material. A friction brake 89 may be associated with each supply spool 62 to provide so me resistance to rotation, thereby preventing excessive acceleration.

Also as shown in FIG. 3, a central shaft 90 coaxially surrounds cam shaft 80, which is free to slide therein. The inner end of central shaft 90 terminates in a central gear 92, while the outer end of central shaft 90 terminates in a drive gear 94. Each take-up spool 62 is coupled to a take-up gear 98 by means of a shaft 100, which, in turn, passes through a one-way clutch 102 (see FIG. 3, which illustrates shaft $\mathbf{100}_2$ and clutch $\mathbf{102}_2$). With reference to FIG. 2, take-up gear $\mathbf{98}_1$ meshes with an intermediate gear (or an odd number of intermediate gears) 104, which itself meshes with central gear 92. Take-up gear $\mathbf{98}_2$ can mesh directly with central gear 92 or, as shown, by means of a pair (or other even number) of intermediate gears 106, 108, the latter of which meshes with central gear 92. (The intermediate gears are omitted from FIG. 3 for clarity.) As will become clear, different numbers of intermediate gears are used to facilitate independent control of the different winding mechanisms by opposite rotations of cylinder 12.

Drive gear 94 meshes with a brake gear 112, which extends from an electrically controlled (e.g., magnetic particle) brake 115. An optional manual drive motor 117 terminates in a motor gear 120, which meshes with drive gear 94.

Operation of the illustrated plate-winding mechanisms is as follows. Ordinarily, central shaft 90 rotates with cylinder 12 and gears 98, 104, 106, 108 remain stationary with respect to central shaft 90; drive gear 94 rotates with respect to brake gear 112, which offers no resistance thereto. To cause plate material to be wound onto, for example, take-up spool $\mathbf{62}_1$, the operator notifies a controller 125, which actuates cylinder 88 to cause retraction of cam shaft 80, thereby disengaging pawl $\mathbf{70}_1$ and releasing supply spool $\mathbf{60}_1$. Controller 125 also engages brake 115. With brake 115 engaged, rotation of central shaft 90 and central gear 92 is arrested. Cylinder 12 continues to rotate, how ever; assuming counterclockwise rotation (as indicate d by the arrow in FIG. 2) and with central gear 92 now rendered stationary, rotation of cylinder 12 causes intermediate gear 104 to rotate about shaft gear 90 as a "planetary" gear, turning take-up gear $\mathbf{98}_1$ in a clockwise direction to draw plate material from supply spool $\mathbf{60}_1$ (itself now free to rotate due to disengagement of pawl $\mathbf{70}_1$). Reverse rotation of take-up spool $\mathbf{62}_1$, is prevented by the one-way clutch. Because of the even number of intermediate gears coupling central gear 90 to take-up gear $\mathbf{98}_2$, the rotation of the other take-up spool $\mathbf{62}_2$, if Permitted, would be such as to relieve tension rather than take up plate material. Tension is maintained, however, by virtue of one-way clutch $\mathbf{102}_2$, which allows take-up gear $\mathbf{98}_2$ to rotate without affecting take-up spool $\mathbf{62}_2$.

Controller 125 monitors rotation of cylinder 12 by means of angular encoder 36. When cylinder 12 has rotated, with central gear 92 stationary, a sufficient amount to withdraw the appropriate length of plate material from supply spool $\mathbf{60}_1$, controller 125 causes air cylinder 88 to extend cam shaft 80 back into the middle position, re-engaging pawl $\mathbf{70}_1$ and ratchet $\mathbf{68}_1$ and, consequently, locking supply spool $\mathbf{60}_1$. Brake 115, however, remains active, preventing rotation of gears 112, 94, and 92, so that intermediate gear 104 continues to turn about central gear 92 as cylinder 12 rotates. As additional plate material is wound onto take-up spool $\mathbf{62}_1$, the tension in the plate material along the portion $\mathbf{65}_1$ of cylinder 12 increases. This augments the torque on gear 94 and, consequently, on brake 115 as well. The maximum allowed torque on brake 115 may be set by the user (e.g., in the case of a current-limited brake, by the applied electrical current) or computed by controller 125. When this torque is exceeded, brake 115 slips and gear 94 begins to rotate. This results in cutoff of power to brake 115. Unimpeded by brake 115, central shaft 90 and gear 92 are then free once again to rotate. The tension established along the withdrawn plate material is maintained by the one-way clutch (which prevents material from leaving take-up spool $\mathbf{98}_1$) and ratchet $\mathbf{68}_1$ and pawl $\mathbf{70}_1$ (which prevent material from being drawn off supply spool $\mathbf{68}_1$).

It is not necessary to immediately detect the point at which brake 115 slips. Since some rotation of gear 112 past the point of brake slippage is harmless, a simple timing circuit (tied, for example, to actuation of air cylinder 88) can be used to cut power to brake 125 when it can be safely assumed that it has slipped. Alternatively, if more precision is desired, a detector gear (not shown) can be utilized; this is gear meshes with gear 94 and is also coupled to a resettable relay that cuts power to brake 115 as soon as the detector gear begins to rotate, reflecting slippage of brake 115.

It is also possible to add precision to the manner in which plate material is dispensed. In general, the amount of material actually paid out during a cycle is equal to the length of the area to be imaged plus a gap of at least about 0.5 inch, which ensures that the new image will not overlap the old image. For example, some material may be wound by a take-up spool 62 before any material is actually drawn from the corresponding supply spool 60; unless slightly more material is taken up than would be necessary in a system devoid of slackness, the result could be insufficient payout. To avoid the need for this additional material, means can be introduced to monitor supply spools 60 or material wrapped therearound to detect the onset of rotation (and actual payout), when it is appropriate to begin monitoring the rotation of cylinder 12—i.e., when the advancement cycle truly commences. This detection means can be, for example, a gear associated with each the supply spools or a spring-loaded rubber wheel riding on the surface of the undispensed plate material, which is configured to signal controller 125 as soon as it begins to turn. In designs utilizing one or more motors 117, an encoder can be associated with each gear 120. To advance material from supply spool $\mathbf{60}_2$ to take-up spool $\mathbf{62}_2$, the foregoing procedure is implemented with cylinder 12 rotating in the opposite direction.

As an alternative to the use of cylinder rotation to advance plate material, one or more manual drive motors 117 with associated magnetic clutches 119 may be employed instead. In this mode of operation, rotation of cylinder 12 is stopped, and controller 125 operates air cylinder 88 to disengage the appropriate pawl 70. Controller 125 then activates motor 117 and the associated clutch 119, turning gear 94 (and, therefore, central gear 92) in the appropriate direction to dispense plate material from the selected supply spool. Motor 117 turns until the appropriate amount of material has been withdrawn, at which point controller 125 turns off the clutch 119 and causes air cylinder 88 to return cam shaft 80 to the middle position, thereby re-engaging the pawl. Controller 125 once again activates clutch 119 to tension the material, the degree of tension being controlled by the current supplied to the clutch, following which the motor and clutch are both deactivated. It should be noted that a single reversible motor 117 can be used to drive gear 94 in either direction, or separate motors 117, each rotatable in opposite directions, can be employed instead.

As noted earlier, the foregoing arrangement is exemplary only. More typically in connection with the present invention, multiple mechanisms are distributed around the circumference of a large plate cylinder with different sets of axially displaced gear trains. Advancement or retraction of central gear 92 determines the gear train (i.e., the set of intermediate and take-up gears) engaged by central gear 92, and therefore the mechanism (or mechanisms) subject to control. Once again, each axial position can govern two mechanisms with odd and even numbers of intermediate gears, so that a different mechanism is addressed depending on the direction of rotation of cylinder 12.

It will therefore be seen that we have developed a multicolor press and printing method that may combine a simplified configuration requiring only a single plate cylinder, blandit member and impression cylinder with a reliable and convenient mechanism for dispensing and receiving material that wraps around a cylinder. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A multicolor lithographic printing press comprising:

a. a plate cylinder having a diameter, a circumference, and a plurality of image regions extending fully around the circumference the plate cylinder being configured to receive plate material extending over all of the image regions;

b. at least one imager for placing a lithographic image on the plate material at each of the image regions;

c. at least one inking mechanism for transferring ink to each of the images, the images each receiving ink of a different color;

d. a single blanket member in rolling contact with the plate cylinder for sequentially receiving the ink from each of the images as the plate cylinder rotates the blanket member having a diameter less than the diameter of the plate cylinder; and e. an impression member for receiving a recording medium, the impression member being in rolling contact with the blanket member, the blanket and impression members cooperating to successively transfer the ink from each of the images onto the recording medium.

2. The press of claim 1 wherein the blanket member transfers substantially all of the ink to the recording medium, the blanket member sequentially receiving from the images and transferring to the recording medium the different colors of ink.

3. The press of claim 1 wherein the plate cylinder has a circumference, a diameter D and N image regions evenly distributed about the circumference, the blanket member having a diameter substantially equal to D/N.

4. The press of claim 1 wherein the plate cylinder has a circumference and four image regions evenly distributed about the circumference.

5. The press of claim 4 wherein the plate cylinder has a plate-cylinder diameter and the blanket member has a blanket-member diameter, the plate-cylinder diameter being four times the blanket-member diameter.

6. The press of claim 4 comprising four imagers evenly distributed about the plate-cylinder circumference.

7. The press of claim 1 further comprising:

f. distributed about the plate cylinder, a plurality of winding mechanisms equal in number to the image regions, each winding mechanism including (i) first and second rotatable spools within the plate cylinder, (ii) means for winding material onto the second spool, the first spool of each winding mechanism dispensing a rolled supply of plate material over a travel path extending around the cylinder over one of the image regions to the second spool of an adjacent winding mechanism, the second spool of each winding mechanism permitting winding of dispensed plate material therearound, and (iii) tensioning means for establishing a predetermined amount of tension on the plate material across the travel path; and g. means for causing advancement of a predetermined amount of a predetermined amount of untensioned material from a selected winding mechanism onto the second spool of an adjacent winding mechanism.

8. The apparatus of claim 7 wherein the winding means comprises means for coupling movement of the plate material along a travel path to rotation of the plate cylinder.

9. The apparatus of claim 7 wherein each winding mechanism further comprises:

h. means for locking the first spool;

i. means for maintaining a predetermined amount of tension along the plate material originating with the first spool and wrapped around the plate cylinder;

j. means for selectably disengaging the locking means;

k. means for causing rotation of the plate cylinder to (i) draw material from the first spool around the cylinder into an adjacent winding mechanism, or (ii) draw material from an adjacent winding mechanism around the plate cylinder onto the second spool; and l. means for monitoring the amount of plate material dispensed from the first spool and, upon dispensation of a predetermined amount of material, re-engaging the locking means, thereby re-establishing the predetermined amount of tension along the plate material originating with the first spool and wrapped around the plate cylinder.

10. The apparatus of claim 7 wherein each winding mechanism further comprises:

h. means for locking the first spool;

i. means for maintaining a predetermined amount of tension along the plate material originating with the first spool and wrapped around the plate cylinder; and j. means for selectably disengaging the locking means, the apparatus further comprising:

k. a center gear, the first spool of a first winding mechanism being geared to the center gear by an even number of gears, the first spool of a second winding mechanism being geared to the center gear by an odd number of gears; and l. at least one motor for (i) causing rotation of the center gear in a first direction to draw material from the first spool of a first winding mechanism around the cylinder into a second winding mechanism, or (ii) causing rotation of the center gear in a second direction to draw material from the first spool of the second winding mechanism around the cylinder into the first winding mechanism; and m. means for monitoring the amount of plate material dispensed from each first spool and, upon dispensation of a predetermined amount of material, causing the motor to re-establish the predetermined amount of tension along the material wrapped around the cylinder, wherein said means for causing advancement comprises at least one motor for (i) causing rotation of the center gear in a first direction to draw material from the first spool of a first winding mechanism around the cylinder into a second winding mechanism, or (ii) causing rotation of the center gear in a second direction to draw material from the first spool of the second winding mechanism around the cylinder into the first winding mechanism.

11. The press of claim 1 wherein the at least one inking mechanism further comprises a reciprocation assembly for actuating the inking mechanism to contact the plate cylinder only when angularity adjacent to a predetermined image region.

12. A printing method comprising:

a. providing a plate cylinder having a diameter, a circumference, and a plurality of image regions extending fully around the circumference;

b. disposing plate material on the plate cylinder;

c. placing a lithographic image on the plate material at each of the image regions;

d. transferring ink to each of the images, the images each receiving ink of a different color;

e. using a single blanket member in rolling contact with the plate cylinder to sequentially receive the ink from each of the images as the plate cylinder rotates and to successively transfer the ink from each of the images onto a recording medium wherein the blanket member has a diameter less than the diameter of the plate cylinder.

* * * * *